US009598918B2

(12) United States Patent
McIntosh et al.

(10) Patent No.: US 9,598,918 B2
(45) Date of Patent: Mar. 21, 2017

(54) TUBULAR HANDLING SYSTEM

(71) Applicant: 2M-TEK, Inc., Scott, LA (US)

(72) Inventors: Richard McIntosh, Scott, LA (US); Toby Scott Baudoin, Scott, LA (US)

(73) Assignee: 2M-TEK, Inc., Scott, LA (US)

( * ) Notice: Subject to any disclaimer, the term of this patent is extended or adjusted under 35 U.S.C. 154(b) by 0 days.

(21) Appl. No.: 14/928,173

(22) Filed: Oct. 30, 2015

(65) Prior Publication Data

US 2016/0115749 A1 Apr. 28, 2016

Related U.S. Application Data

(63) Continuation-in-part of application No. 13/635,505, filed on Sep. 21, 2012, now Pat. No. 9,175,527, and a continuation-in-part of application No. 13/980,769, filed on Jul. 19, 2013, now Pat. No. 9,273,523, and a continuation-in-part of application No. 13/636,541, filed on Sep. 21, 2012, now Pat. No. 9,181,763, and a continuation-in-part of application No. 13/326,061, filed on Dec. 14, 2011, now Pat. No. 9,187,967.

(60) Provisional application No. 61/340,894, filed on Mar. 24, 2010, provisional application No. 61/435,157, filed on Jan. 21, 2011, provisional application No. 61/340,893, filed on Mar. 24, 2010.

(51) Int. Cl.

| | |
|---|---|
| ***E21B 19/06*** | (2006.01) |
| ***E21B 19/16*** | (2006.01) |
| ***E21B 19/07*** | (2006.01) |
| ***E21B 19/15*** | (2006.01) |

(52) U.S. Cl.

CPC ..... *E21B 19/16* (2013.01); *E21B 19/06* (2013.01); *E21B 19/07* (2013.01); *E21B 19/155* (2013.01); *E21B 19/168* (2013.01)

(58) Field of Classification Search

CPC ..... E21B 19/06; E21B 19/07; E21B 19/10; E21B 19/16; E21B 19/155

USPC ..... 294/194, 102.2; 166/77.51, 77.52, 77.53

See application file for complete search history.

(56) References Cited

U.S. PATENT DOCUMENTS

| | | | |
|---|---|---|---|
| 1,502,628 | A | 7/1924 | Hanna |
| 2,392,462 | A | 1/1946 | Coe |
| 3,385,370 | A | 5/1968 | Knox et al. |
| 4,364,407 | A | 12/1982 | Hilliard |
| 4,441,749 | A | 4/1984 | Blaschke et al. |

(Continued)

FOREIGN PATENT DOCUMENTS

| | | |
|---|---|---|
| IN | 0506/KOLNP/2003 | 3/2005 |
| IN | 0882/DELNP/2008 | 6/2008 |

(Continued)

*Primary Examiner* — Dean Kramer

(74) *Attorney, Agent, or Firm* — Gregory L. Porter; Lloyd L. Davis; Andrews Kurth Kenyon LLP

(57) ABSTRACT

A system for facilitating the connection of a first tubular to a second tubular used in the oil and gas exploration and extraction industries includes a tubular handling device having a body having a profile shaped to accept a first tubular into a throat area and opposing scissor plates with overlapping tips. The system further includes a tubular engagement apparatus to engage and raise a tubular to a vertical position, and a spider apparatus including a plurality of slip assemblies. The slip assemblies include a slip back with an inclined load bearing surface, and a slip with a load bearing surface in sliding abutment with the inclined load bearing surface of the slip back.

8 Claims, 4 Drawing Sheets

(56) References Cited

U.S. PATENT DOCUMENTS 4,643,472 A 2/1987 Schukei et al.
4,647,099 A 3/1987 Berry et al.
4,658,905 A 4/1987 Burge
5,221,099 A 6/1993 Jansch
5,297,833 A 3/1994 Willis et al.
5,335,756 A 8/1994 Penisson
5,437,489 A 8/1995 Sanders et al.
5,451,084 A 9/1995 Jansch
5,479,988 A 1/1996 Appleton
5,484,040 A 1/1996 Penisson
5,484,222 A 1/1996 Schulze-Beckinghausen
5,522,464 A 6/1996 Piper
5,537,900 A 7/1996 Schaar
5,669,653 A 9/1997 Penisson
5,671,961 A 9/1997 Buck
5,702,139 A 12/1997 Buck
5,704,393 A 1/1998 Connell et al.
5,732,909 A 3/1998 Sonnier
5,778,742 A 7/1998 Stuart
5,791,206 A 8/1998 Daigle et al.
5,791,410 A 8/1998 Castille et al.
5,842,390 A 12/1998 Bouligny et al.
5,848,647 A 12/1998 Webre et al.
5,909,768 A 6/1999 Castille et al.
5,967,477 A 10/1999 Walmsley
5,971,079 A 10/1999 Mullins
5,971,086 A 10/1999 Bee et al.
5,992,801 A 11/1999 Torres
5,996,444 A 12/1999 Pearce et al.
6,012,360 A 1/2000 Concha
6,089,338 A 7/2000 Bouligny, Jr. et al.
6,116,118 A 9/2000 Wesch, Jr.
6,138,529 A 10/2000 Pietras
6,173,777 B1 1/2001 Mullins
6,192,981 B1 2/2001 Boquet et al.
6,212,976 B1 4/2001 Stogner
6,227,587 B1 5/2001 Terral
6,237,632 B1 5/2001 Smith, III
6,264,395 B1 7/2001 Allamon et al.
6,279,662 B1 8/2001 Sonnier
6,290,267 B1 9/2001 Swingley
6,305,649 B1 10/2001 Walmsley et al.
6,311,792 B1 11/2001 Scott et al.
6,352,115 B1 3/2002 Mathieu
6,378,399 B1 4/2002 Bangert
6,394,201 B1 5/2002 Feigel et al.
6,431,029 B1 8/2002 Hawkins, III
6,471,439 B2 10/2002 Allamon et al.
6,571,876 B2 6/2003 Szarka
6,631,792 B2 10/2003 Buck
6,637,526 B2 10/2003 Juhasz et al.
6,640,939 B2 11/2003 Buck
6,666,273 B2 12/2003 Laurel
6,698,517 B2 3/2004 Simpson et al.
6,755,746 B2 6/2004 Barnley et al.
6,820,705 B2 11/2004 Baugh
6,830,064 B2 12/2004 Ji
6,832,656 B2 12/2004 Fournier
6,845,814 B2 1/2005 Mason et al.
6,938,520 B1 9/2005 Stuart
6,948,904 B2 9/2005 Bunn et al.
6,991,265 B2 1/2006 Welmsley et al.
7,036,397 B2 5/2006 Bangert
7,048,079 B1 5/2006 Parker
7,055,594 B1 6/2006 Springett et al.
7,086,461 B2 8/2006 Schulze-Beckinghausen et al.
7,090,254 B1 8/2006 Pietras et al.
7,100,693 B2 9/2006 Collins et al.
7,121,166 B2 10/2006 Drzewiecki
7,140,445 B2 11/2006 Shahin et al.
7,252,161 B2 8/2007 Ayling
7,267,168 B1 9/2007 Sipos
7,293,618 B2 11/2007 Belik
7,377,324 B2 * 5/2008 Beierbach ..... E21B 19/06 166/380
7,395,855 B2 7/2008 Ayling
7,419,008 B2 9/2008 Campisi et al.
7,445,050 B2 11/2008 Kuttel et al.
7,552,764 B2 6/2009 Weems et al.
7,578,378 B2 8/2009 Gebert et al.
7,637,324 B2 12/2009 Anderson et al.
7,681,649 B2 3/2010 Cerovsek
7,686,088 B2 3/2010 Shahin
7,743,787 B2 6/2010 Baugh
7,744,140 B2 6/2010 Rowley
7,762,343 B2 7/2010 Sonneveld et al.
7,775,270 B1 8/2010 Sipos
7,832,470 B2 11/2010 Anthony
7,854,266 B2 12/2010 Watson
7,866,721 B2 1/2011 Hollin
7,891,469 B1 2/2011 Sipos
7,926,577 B2 4/2011 Thomas et al.
7,958,787 B2 6/2011 Hunter
7,980,298 B2 7/2011 Halse
8,011,426 B1 9/2011 Orgeron
8,020,627 B2 9/2011 Shahin et al.
8,074,711 B2 12/2011 Ellis et al.
8,079,627 B2 12/2011 Lutzhoff et al.
8,215,687 B2 7/2012 Pietras et al.
8,267,450 B2 9/2012 Aarhus et al.
8,281,877 B2 10/2012 Shahin et al.
8,327,828 B2 12/2012 Song
8,327,867 B2 12/2012 Caleffi
8,419,097 B2 4/2013 Lunde
8,474,806 B2 7/2013 Orgeron
8,496,238 B1 7/2013 Orgeron
8,544,914 B2 10/2013 Hessels et al.
8,678,112 B2 3/2014 Vatne
8,689,828 B2 4/2014 Smith, III
8,720,541 B2 5/2014 Ellis et al.
8,720,542 B2 5/2014 Hughes et al.
8,720,589 B2 5/2014 Thibodeaux, Jr. et al.
8,851,164 B2 10/2014 Ellis et al.
8,939,214 B2 1/2015 Litherland et al.
9,010,445 B2 4/2015 Yajure
9,175,527 B2 * 11/2015 McIntosh ..... E21B 19/06
9,181,763 B2 * 11/2015 McIntosh ..... E21B 19/10
9,187,967 B2 * 11/2015 McIntosh ..... E21B 21/106
9,273,523 B2 * 3/2016 McIntosh ..... E21B 19/06
2001/0032675 A1 10/2001 Russell et al.
2005/0061548 A1 * 3/2005 Hooper ..... E21B 19/20 175/52
2005/0161225 A1 7/2005 Cole et al.
2005/0166715 A1 8/2005 Rogers
2005/0224260 A1 10/2005 Ayling
2005/0262690 A1 12/2005 Swaffar
2006/0000601 A1 1/2006 Pietras et al.
2006/0011350 A1 1/2006 Wiggins et al.
2007/0044976 A1 3/2007 Isaacks et al.
2007/0095524 A1 5/2007 Lesko et al.
2007/0163807 A1 7/2007 Lutzhoft et al.
2007/0228753 A1 10/2007 Dugal et al.
2007/0251700 A1 * 11/2007 Mason ..... E21B 19/06 166/379
2008/0007056 A1 1/2008 Beesley
2008/0060818 A1 * 3/2008 Bourgeois ..... E21B 19/087 166/380
2008/0060850 A1 3/2008 Stanton et al.
2008/0136203 A1 6/2008 Krijnen et al.
2008/0216999 A1 9/2008 Halse et al.
2009/0120649 A1 5/2009 Cerovsek et al.
2009/0229424 A1 9/2009 Montgomery et al.
2009/0229837 A1 9/2009 Wiens et al.
2009/0235994 A1 9/2009 Lubinski et al.
2009/0252589 A1 10/2009 Sonneveld et al.
2009/0321064 A1 12/2009 Ellis et al.
2010/0300704 A1 12/2010 Sweeney et al.
2010/0319932 A1 12/2010 Angelle et al.
2011/0036586 A1 2/2011 Hart et al.
2011/0147010 A1 6/2011 Ellis et al.
2011/0192649 A1 8/2011 Mohon et al.
2011/0240299 A1 10/2011 Vick et al.

(56) References Cited

U.S. PATENT DOCUMENTS

| | | | |
|---|---|---|---|
| 2014/0008556 | A1 | 1/2014 | Ewers et al. |
| 2014/0196909 | A1 | 7/2014 | Ellis et al. |
| 2014/0251631 | A1 | 9/2014 | Curtiss, III |

FOREIGN PATENT DOCUMENTS

| | | | |
|---|---|---|---|
| IN | 9278/DELNP/2008 | | 6/2009 |
| IN | 2685/KOLNP/2010 | | 10/2010 |
| IN | 3307/KOLNP/2012 | | 6/2013 |
| MX | PA05002822 | | 11/2005 |
| MX | PA05004572 | | 5/2006 |
| MX | PA05007202 | A1 | 1/2007 |
| MX | 2008002798 | A1 | 1/2008 |
| MX | 2008013745 | A1 | 2/2009 |
| MX | 2010007870 | A1 | 1/2010 |
| MX | 2010014527 | A1 | 2/2011 |
| MX | 2011000159 | A1 | 5/2011 |
| MX | 2011002619 | A1 | 6/2011 |
| MX | 2011007928 | A | 12/2011 |
| WO | 2008034262 | A1 | 3/2008 |
| WO | 2009025832 | A1 | 2/2009 |
| WO | 2012100019 | A1 | 7/2012 |
| WO | 2014164209 | A1 | 10/2014 |
| WO | 2014183929 | A1 | 11/2014 |

* cited by examiner

TUBULAR HANDLING SYSTEM

CROSS-REFERENCE TO RELATED APPLICATIONS

This application claims benefit under 35 U.S.C. §120 of U.S. patent application Ser. No. 13,636,505, filed Mar. 22, 2011, which claimed priority to U.S. Provisional Application No. 61/340,894, filed on Mar. 24, 2010; U.S. patent application Ser. No. 13/980,769, filed Jul. 19, 2013, which claimed prior to U.S. Provisional Application No. 61/435,157, filed on Jan. 21, 2011; U.S. patent application Ser. No. 13/636,541, filed Mar. 22, 2011, which claimed priority to U.S. Provisional Application No. 61/340,893; and U.S. patent application Ser. No. 13/326,061 filed Dec. 14, 2011, all of which are incorporated by reference herein in their entireties.

FIELD

Embodiments disclosed herein relate to a system for facilitating the connection of tubulars used in the oil and gas exploration and extraction industries.

BACKGROUND AND SUMMARY

In the construction of oil or gas wells it is usually necessary to line the wellbore with a string of steel pipes commonly known as a "tubular" or tubing or generically as oil country tubular goods ("OCTG"). Because of the length of the tubular string required, individual sections of tubular are typically progressively added to the string in the wellbore as it is lowered into a well from a drilling rig or platform. The section to be added is restrained from falling in to the well by some tubular engagement means, typically a spider, and is lowered into the well to position the threaded pin of the tubular adjacent the threaded box of the tubular in the wellbore. The sections are then joined by relative rotation of the sections until such time as the desired total length has been achieved.

In one aspect, embodiments disclosed herein relate to a system for facilitating the connection of a first tubular to a second tubular used in the oil and gas exploration and extraction industries. The system includes a tubular handling device having a body having a profile shaped to accept a first tubular into a throat area and opposing scissor plates with overlapping tips, whereby each scissor plate rotates about a fixed axis and is actuated to open and close around the first tubular. The system further includes a tubular engagement apparatus having a first member comprising a plurality of indentations disposed in a surface of the first member, each indentation comprising an inclined surface relative to a longitudinal axis of the first member, a second member concentrically disposed relative to the first member, the second member comprising a plurality of openings, and a plurality of non-spherical rolling supports, each support disposed within an indentation of the first member, and each rolling support corresponding to an opening in the second member, wherein movement of the second member relative to the first member urges the rolling supports along the inclined surfaces of indentations of the first member.

BRIEF DESCRIPTION OF THE DRAWINGS

The invention is illustrated in the accompanying drawings wherein.

DETAILED DESCRIPTION

Embodiments disclosed herein relate to a system for facilitating the connection of tubulars used in the oil and gas exploration and extraction industries. The system may include one or more combinations of a tubular engagement apparatus, a tubular handling apparatus, and a flush mounted spider apparatus. Other embodiments may also include a fluid safety valve coupled to the tubular engagement apparatus. A fluid safety valve has been described by, for example, U.S. patent application Ser. No. 13/326,061, which is incorporated by reference herein in its entirety.

Figure 1:
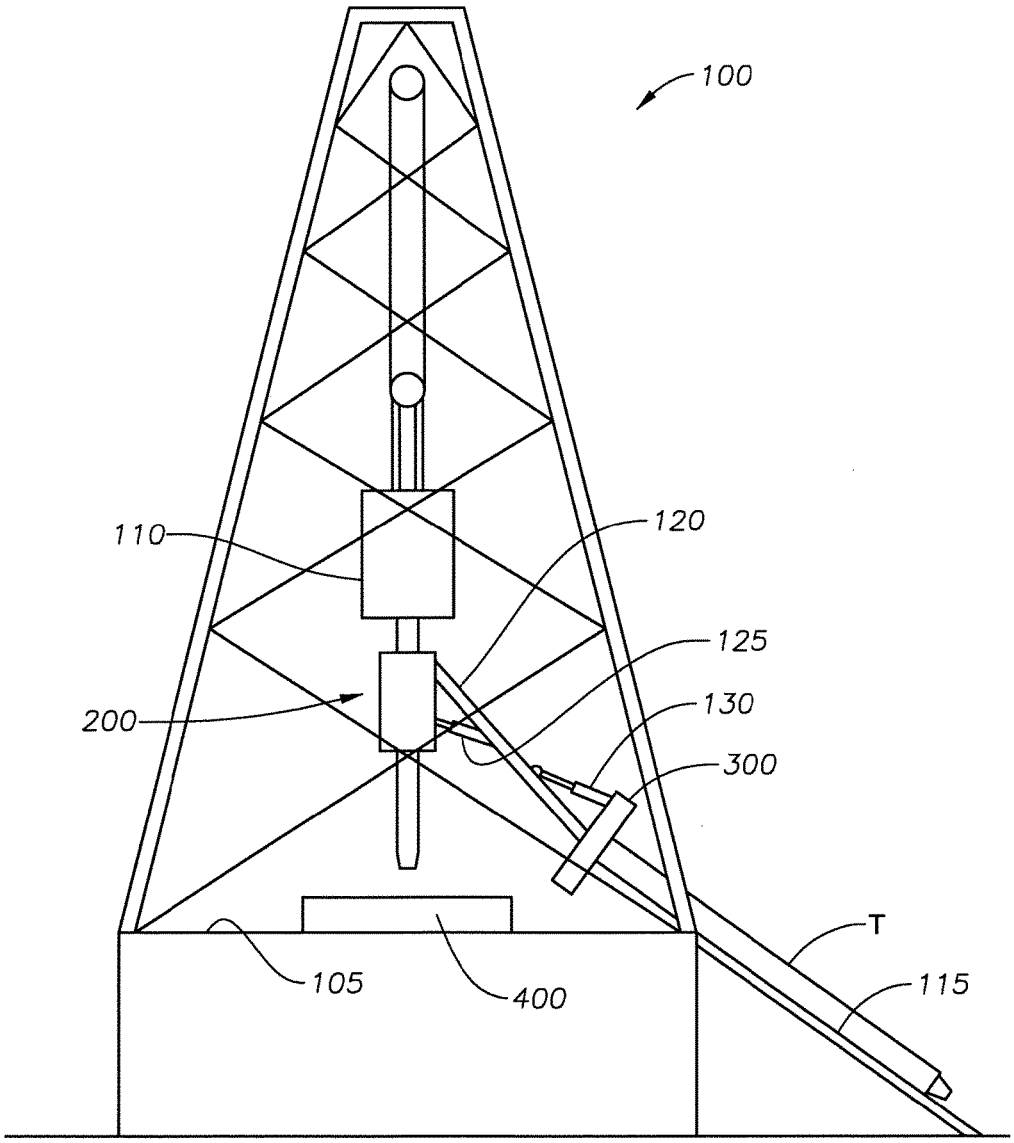
FIG. 1 illustrates an embodiment of a drilling or workover rig.
Figure 4:
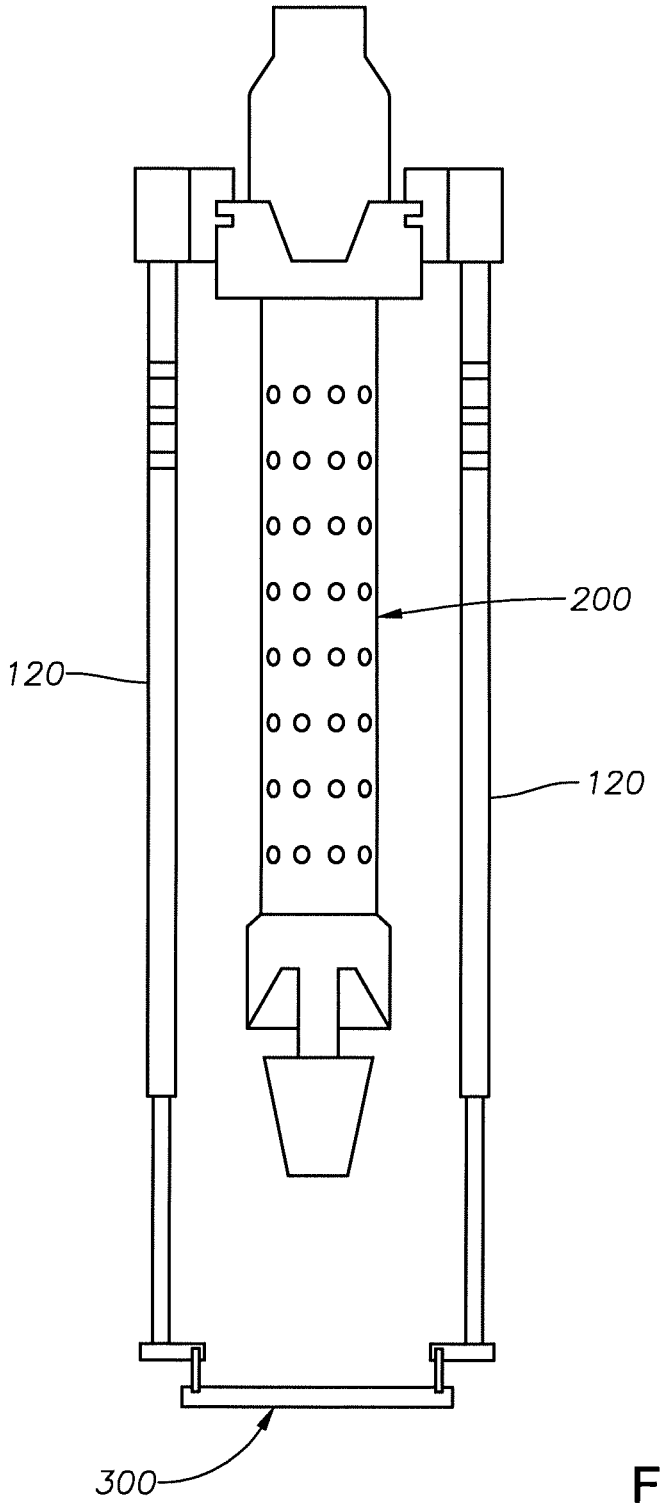
FIG. 4 illustrates an embodiment of a tubular engagement apparatus and a tubular handling device.

FIG. 1 illustrates an embodiment of a drilling or workover rig 100. The rig includes a top drive 110, a tubular engagement apparatus 200, a tubular handling apparatus 300, and a spider apparatus 400 mounted in the rig floor 105. The tubular handling device 300 may be used as an elevator to latch onto tubular T from a V-door 115 to allow the tubular to be raised to a vertical position. The tubular handling device 300 may be attached to link arms 120, which may be manipulated to pivot via hydraulic or pneumatic cylinders 125. Shock dampening cylinders 130 are configured to maintain the tubular handling device 300 in a substantially perpendicular position in relation to the link arms 120 while providing a degree of flexibility. As the tubular handling device latches onto the tubular, it must be allowed to become perpendicular with the tubular for proper engagement. Thus the tubular handling device may not be always be exactly perpendicular to the link tilts for brief periods of time surrounding the actual latching. As the tubular is being lifted, the shock dampening cylinders 130 are configured to urge the tubular handling device 300 back to its original perpendicular orientation. FIG. 4 illustrates a side view of an embodiment of a tubular engagement apparatus 200 and tubular handling device 300, and link arms 120 therebetween.

Figure 2B:
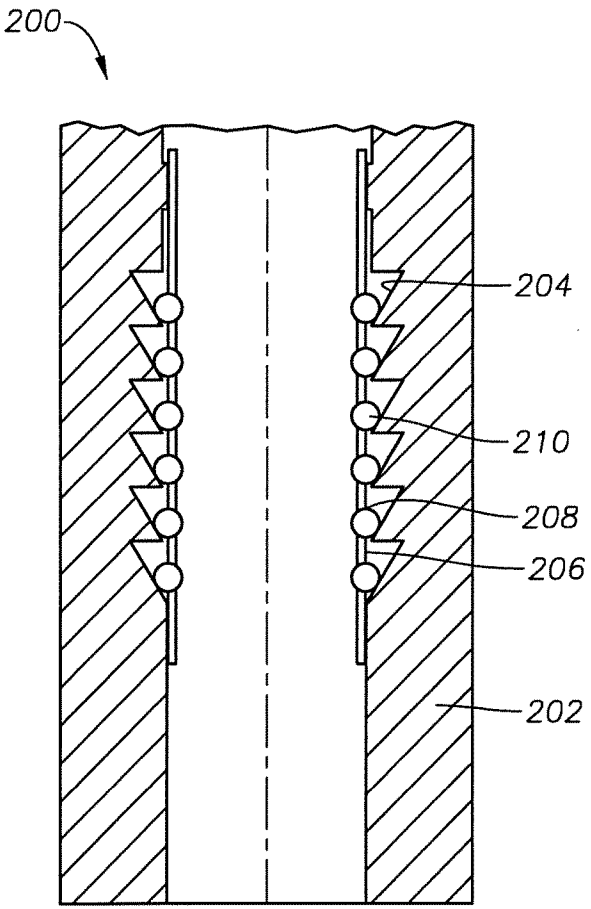
FIGS. 2A and 2B illustrate embodiments of a tubular engagement apparatus.
Figure 2A:
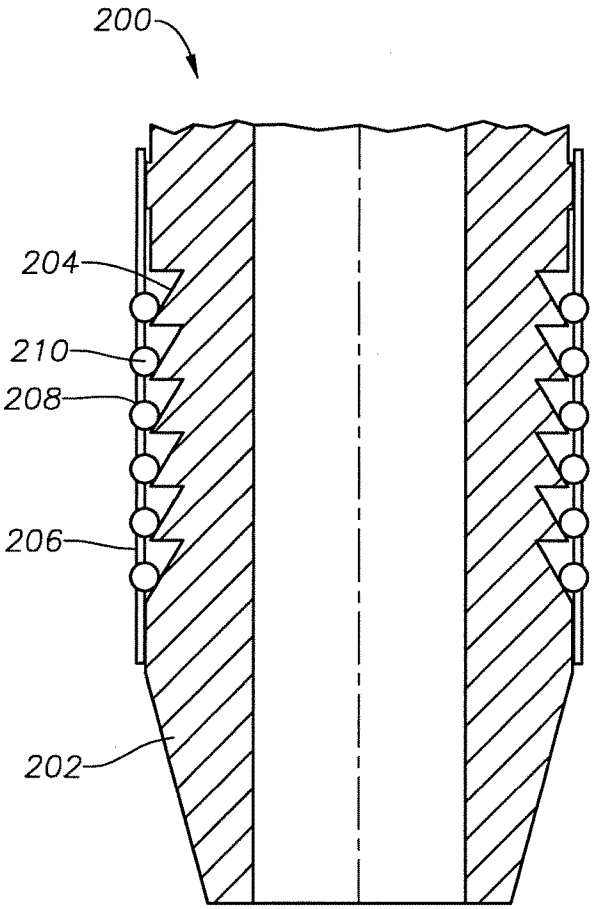

FIGS. 2A and 2B illustrate embodiments of a tubular engagement apparatus 200 comprising a first member 202 having a plurality of ramped or inclined surfaces 204, a second member 206 having a plurality of openings 208, and a plurality of non-spherical rolling supports 210 mounted upon and aligned with respective inclined surfaces 204 of the first member 202. The rolling supports 210 may be constrained by the second member 206 while allowing the rolling supports 210 to travel up or down the ramped or inclined surfaces 204. The tubular engagement apparatus shown in FIG. 2A may be configured to grip the internal surface of a tubular and the tubular engagement apparatus shown in FIG. 2B may be configured to grip the external surface of a tubular. A tubular engagement apparatus has been described by, for example, U.S. patent application Ser. No. 13/980,769, which is incorporated by reference herein in its entirety.

Figure 3:
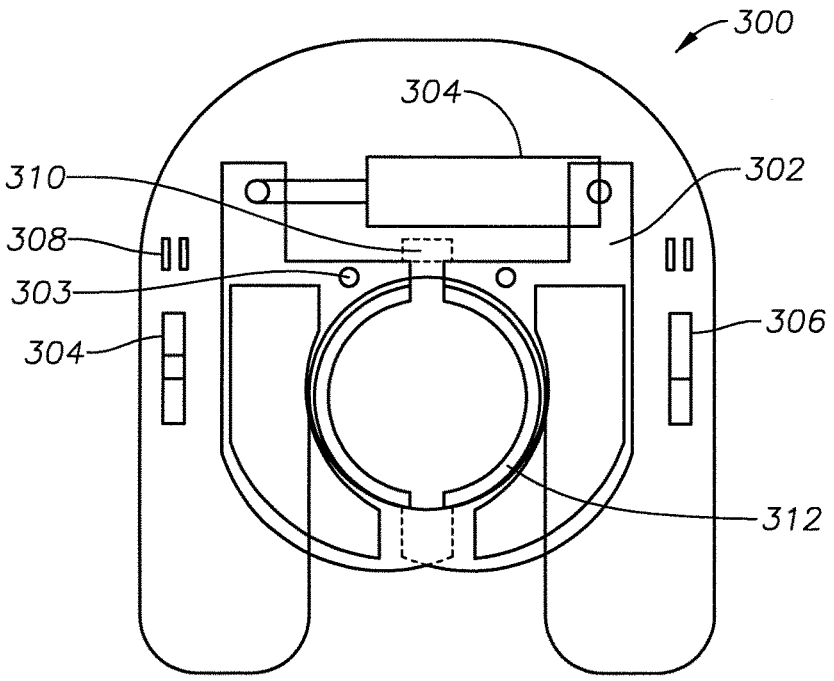
FIG. 3 illustrates an embodiment of a tubular handling device.

FIG. 3 illustrates a top view of an embodiment of a tubular handling device 300. The tubular handling device 300 includes two scissor plates 302 that rotate about an axis through hole 303. Hydraulic or pneumatic cylinder 304 provides the force necessary to open and close the scissor plates 302 about a tubular. Pad eyes 306 provide a means to connect the tubular handling device to the link arms 120 (FIG. 1 and FIG. 4), or equivalent bail arms, or cables, etc. depending upon the application it is to be used in. Pad eyes 308 provide a means to connect the tubular handling device 300 to the shock dampening cylinders 130 (FIG. 1) when used as an elevator. Safety latch mechanism 310 provides a means to insure that the scissor plates do not open or release a tubular unintentionally in the case of hydraulic or pneumatic failure. Die blocks 312 may be included and held in place via die retainers (not shown for clarity) onto the scissor plates 302. A tubular handling device or "THD" has been described by, for example, U.S. patent application Ser. No. 13/636,505, which is incorporated by reference herein in its entirety.

Figure 5:
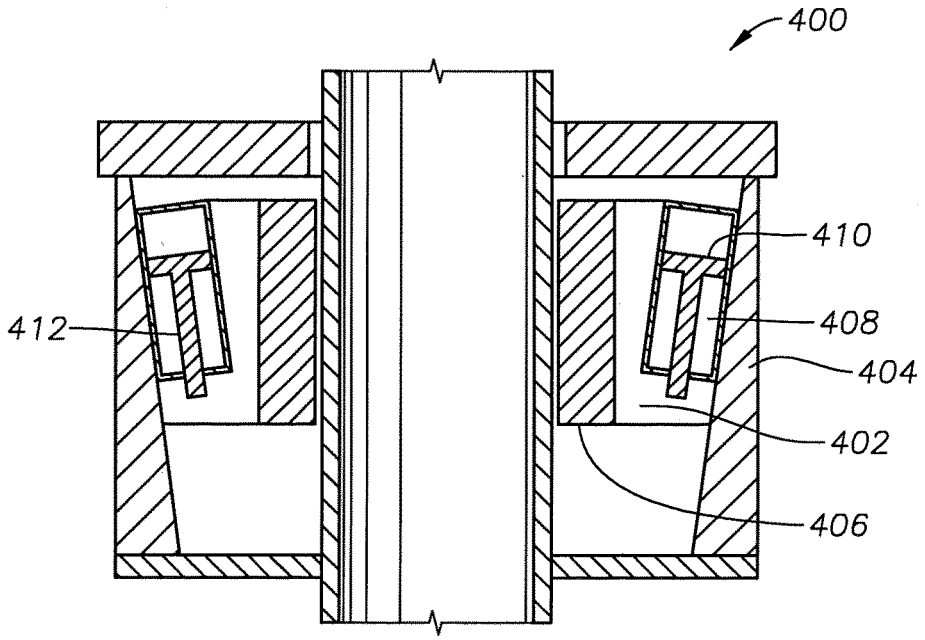
FIG. 5 illustrates an embodiment of a spider apparatus.

FIG. 5 illustrates a cross section view of an embodiment of a gripping apparatus 400. The gripping apparatus 400 may be used as a flush mounted spider to operate in a rig floor 105 (FIG. 1). Slips 402 are in sliding engagement with slip backs 404. Die inserts 406 may be attached to slips 402. Double acting hydraulic cylinders 412 are disposed in a cavity formed between slips 402 and slip backs 404. The hydraulic cylinders 412 may be threadedly connected to a lower surface of slips 402. The upper portion of the hydraulic piston 410 is the largest area of the piston, thus providing a maximum force in a downward direction for a given applied pressure. This provides a greater force to stroke the hydraulic cylinder to latch and grip a tubular than the force to release the grip on a tubular and retract the cylinder. The hydraulic cylinder rod 412 protrudes through a bore in the lower portion of the cylinder. The slip backs 404 contain a cavity 408 to allow pressure conduits access to the retract port of the hydraulic cylinders. A tubular T is disposed in the opening of the gripping apparatus along the central axis. A spider apparatus has been described by, for example, U.S. patent application Ser. No. 13/636,541, which is incorporated by reference herein in its entirety.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

What is claimed is:

1. A system for facilitating the connection of a first tubular to a second tubular used in the oil and gas exploration and extraction industries, the system comprising:

a tubular handling device comprising:

a body having a profile shaped to accept a first tubular into a throat area; and opposing scissor plates with overlapping tips, whereby each scissor plate rotates about a fixed axis and is actuated to open and close around the first tubular;

a tubular engagement apparatus comprising:

a first member comprising a plurality of indentations disposed in a surface of the first member, each indentation comprising an inclined surface relative to a longitudinal axis of the first member;

a second member concentrically disposed relative to the first member, the second member comprising a plurality of openings; and a plurality of non-spherical rolling supports, each support disposed within an indentation of the first member, and each rolling support corresponding to an opening in the second member, wherein movement of the second member relative to the first member urges the rolling supports along the inclined surfaces of indentations of the first member;

wherein the tubular handling device and the tubular engagement apparatus are operably connected so that the tubular handling device engages and retrieves the first tubular from a V-door to raise the first tubular to a vertical position, and wherein once in the vertical position, the tubular engagement apparatus engages an interior surface or an exterior surface of the first tubular; and a spider apparatus comprising a plurality of slip assemblies evenly distributed about a central axis, wherein each slip assembly comprises a slip back with an inclined load bearing surface, a slip with a load bearing surface in sliding abutment with the inclined load bearing surface of the slip back, one or more die inserts with gripping surfaces, and a hydraulic or pneumatic cylinder;

wherein the slips and slip backs have cavities that together form a cylindrical cavity in the slip assembly between the slips and slip backs and the hydraulic or pneumatic cylinders are mounted in the cylindrical cavity to be in axial alignment with the movement of the slip as the slips travel up or down the inclined surfaces of the slip backs.

2. The system of claim 1, wherein the tubular engagement apparatus further comprises rolling supports having a curved profile outermost surface.

3. The system of claim 1, wherein the tubular engagement apparatus non-spherical rolling supports are configured to engage an interior surface or an exterior surface of the first tubular.

4. The system of claim 1, wherein the tubular handling device further comprises:

a die block secured to each die retainer, wherein each die block is configured to be readily replaced to accommodate a range of tubular outside diameters or profiles.

5. The system of claim 1, further comprising one or more link arms attached to the tubular handling device and configured to be manipulated to pivot via cylinders.

6. The system of claim 5, further comprising one or more shock dampening cylinders connected between the tubular handling device and the one or more link arms, wherein the shock dampening cylinders are configured to maintain the tubular handling device in a substantially perpendicular position relative to the link arms.

7. The system of claim 1, wherein the spider apparatus supports a second tubular in a substantially vertical position.

8. The system of claim 7, wherein the first tubular manipulated by the tubular engagement apparatus is aligned with the second tubular supported by the spider apparatus, and the first tubular and the second tubular are connected.

* * * * *